US005876834A

United States Patent [19]

Foy et al.

[11] Patent Number: 5,876,834

[45] Date of Patent: Mar. 2, 1999

[54] PROTECTIVE CHAIN SAW CHAPS

[75] Inventors: Brian Emmett Foy, Chesterfield; Navin Talakchand Tejani, Midlothian, both of Va.

[73] Assignee: E. I. du Pont de Nemours and Company, Wilmington, Del.

[21] Appl. No.: 12,613

[22] Filed: Jan. 23, 1998

Related U.S. Application Data

[60] Provisional application No. 60/036,869, Feb. 5, 1997.

[51] Int. Cl.[6] ..... B32B 23/02

[52] U.S. Cl. ..... 428/192; 2/2.5; 428/902; 428/911; 442/247; 442/320; 442/326

[58] Field of Search ..... 2/2.5; 442/239, 442/247, 320, 326; 428/902, 192, 911

[56] References Cited

U.S. PATENT DOCUMENTS

| | | | |
|---|---|---|---|
| 4,279,956 | 7/1981 | Bartels | 428/192 |
| 5,095,544 | 3/1992 | Elverskog | 2/22 |
| 5,272,822 | 12/1993 | Diaz | 36/2 R |
| 5,343,796 | 9/1994 | Cordova et al. | 89/36.02 |
| 5,395,683 | 3/1995 | Bledsoe et al. | 428/253 |
| 5,415,007 | 5/1995 | Eng | 66/192 |
| 5,440,965 | 8/1995 | Cordova et al. | 89/36.02 |

FOREIGN PATENT DOCUMENTS

| | | |
|---|---|---|
| 0 202 183 A1 | 11/1986 | European Pat. Off. . |
| 2 739 759 | 4/1997 | Greece . |
| WO 96/32621 | 10/1996 | WIPO . |

*Primary Examiner*—James J. Bell

[57] ABSTRACT

A sacrificial fabric structure is disclosed for protection from the moving chain in chain saws. The structure includes fabric woven in a loose satin weave.

10 Claims, 2 Drawing Sheets

PROTECTIVE CHAIN SAW CHAPS

This is based on a provisional patent application number 60/036,869, filed Feb. 5, 1997.

BACKGROUND OF THE INVENTION

This invention relates to sacrificial fabrics for protection from the hazards of the moving chain in chain saws. It has long been known to use special fabrics in garments to provide protection from chain saws.

U.S. Pat. No. 4,279,956, issued Jul. 21, 1981 on the application of Bartels discloses protective pads of a multitude of layers of nylon fabric. The nylon is woven in plain weave or ½ twill weave. Each layer is made using interwoven strips which are torn with more difficulty from the pad structure than when the layers are not interwoven.

U.S. Pat. No. 5,395,683, issued Mar. 7, 1995 on the application of Bledsoe et al. discloses a protective pad made from so-called hybrid fabric layers including knitted fibers of several kinds.

European Patent Application Publication No. 202,183, published Nov. 20, 1986, discloses chain saw protection in a construction of several fabric layers wherein the fabric is loosely woven from aramid yarns and the several layers are loosely stitched together to afford entire breakaway layers to stop the chain. The fabric weave is disclosed to be linen-type (plain).

SUMMARY OF THE INVENTION

There is provided a sacrificial fabric structure for protection from a moving chain saw blade including a plurality of superposed layers of fabric bound together generally around the periphery of the layers and made from yarns having a tenacity of at least 10 grams per dtex and a tensile modulus of at least 150 grams per dtex woven in a 1/x satin weave wherein x is from 3 to 9.

A sacrificial fabric structure is, also, provided including a plurality of superposed layers of fabric made from aramid yarns.

A preferred embodiment of the structure of this invention utilizes aramid yarns which are at least 1200 dtex made from filaments of poly(p-phenylene terephthalamide). The fabric weave is preferably a ⅓ satin weave (also known as 4 harness satin) and the superposed fabric layers are preferably alternated with layers of felt.

DETAILED DESCRIPTION

The yarns used in fabric structures of this invention are yarns formed from continuous filaments. The preferred yarns are made from aramid. By "aramid" is meant a polyamide wherein at least 85% of the amide (—CO—NH—) linkages are attached directly to two aromatic rings. Para-aramids are the primary polymers in fibers of this invention and poly(p-phenylene terephthalamide)(PPD-T) is the preferred para-aramid.

It is the intent to have chainsaw protection materials available for stopping the chain and thereby stalling the chainsaw motor to eliminate or mitigate damage done by the chain. In the case of fabric chainsaw protection, the fabric constituents must be made from strong yarns which are relatively easily ripped from the fabric and drawn into the chain drive. The fabric is, thus, sacrificed to provide protection from the moving chainsaw blades. Aramid yarns have proven to be especially serviceable for use in chainsaw protection materials; and the sacrificial fabric structure of this invention includes a plurality of layers of fabric made from aramid yarns of a particular make-up woven in a particular weave which has been discovered to provide especially effective protection.

The inventors herein have discovered that a significant and surprising improvement in chainsaw protection can be realized by a combination of the strength of aramid fibers and the use of satin weave to render the fibers stable in fabric form but readily available for stopping the chain.

Figure 1:
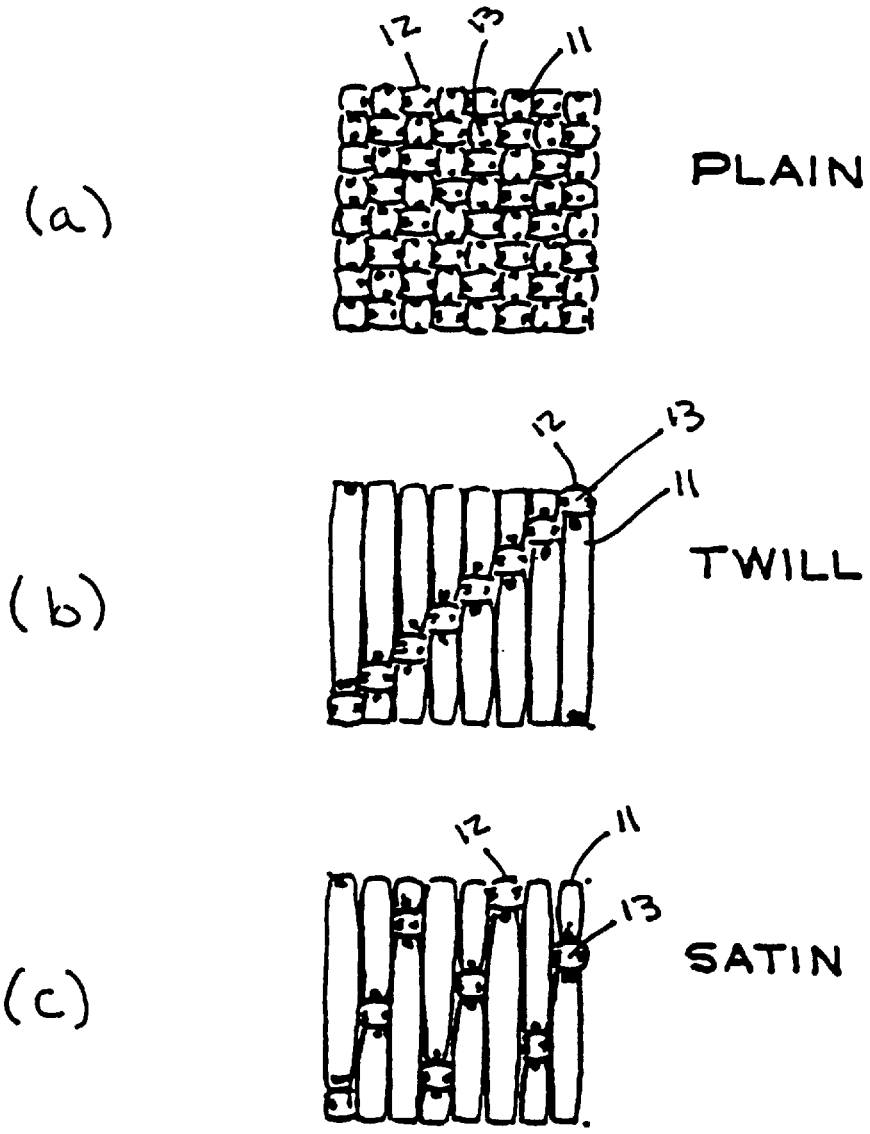
FIG. 1 (*a, b* and *c*) represents a schematic representation of satin, twill, and plain weaves.

Referring to FIG. 1, there are presented stylized representations of three fundamental classes of weave patterns. FIG. 1*a* is a Plain weave pattern wherein each filling yarn (11) passes successively over and under each warp yarn (12), alternating each row and resulting in regular, relatively close-packed fill/warp intersections (13). FIG. 1*b* is a Twill weave pattern wherein each filling yarn (11) is floated over warp yarns (12) in a staggered series to yield a twill or diagonal rib of fill/warp intersections (13). FIG. 1*c* is a Satin weave pattern wherein each filling yarn (11) is floated over warp yarns (12) such that the fill/warp intersections (13) are distributed as evenly and widely separated as possible.

As can be seen from FIG. 1, the satin weave provides a maximum distance between fill/warp intersections while also maximizing the opening between adjacent fill/warp intersections. For chainsaw protection, it has been discovered that, during the short time that the chainsaw is in contact with the fabric, the most protection will be afforded by a fabric which minimizes the number of fill/warp intersections and maximizes the free length of the fiber which is available. Satin weaves maximize the distance in all directions between fill/warp intersections and provides a smoother (rib-free) surface for more even layering of fabric elements.

Satin weave fabrics are used in this invention and satin weaves which are characterized as ⅓ to ⅙ satin weaves, are preferred. The most usually used satin weave is ⅓, also known as 4 harness satin, wherein the fill yarn passes over one and under three warp yarns, in a continuous repeat; and the resulting fill/warp intersections are spaced apart as far as possible. Satin weaves of closer than ⅓ are believed to provide inadequate free fiber with too many fill/warp intersections and low accessibility to the chainsaw. Satin weaves of looser than ⅙ have been found to yield fill yarns which are too easy for the chainsaw to strip from the fabric resulting in inadequate resistance and little slowing of the chain.

It has been discovered that aramid yarns which are useful in this invention have a linear density of at least 200 dtex. Yarns in the structure of this invention must have strength adequate to resist breaking or pulling out of the fabric before the fabric is taken up by the chain. The yarns should have a linear density of 200 to 3400 dtex, preferably 1000 to 1700 dtex; and the filaments in those yarns should be continuous and have a linear density of greater than 1 dtex and up to 8 dtex, preferably greater than 1.5 dtex and up to 5 dtex. The lower limits are necessary to achieve adequate protection and the upper limits are more a matter of convenience of operation. If yarns or filaments are used having linear densities greater than the upper specified limit, it is difficult to form the fabrics and fabrics so-formed are too stiff for easy handling.

In addition to the fabric bulk which is provided by using fabrics made from yarns having a dtex of at least 200 and preferably at least 1000 dtex, the fabric of this invention must have very high strength to cause the fibers to be pulled from the fabric rather than merely broken by the moving chain. The required strength is obtained by using yarns which have a tenacity of at least 10 grams per dtex, preferably at least 15 grams per dtex, and a tensile modulus of 150 to 2000 grams per dtex, preferably 500 to 1500 grams per dtex. A modulus lower than 150 grams per dtex results in excessive fiber stretching in use, and fibers with a modulus higher than 2000 grams per dtex are too stiff for practical use. A tenacity less than 10 grams per dtex results in a fabric which is torn rather than pulled into the chain. As strength is of primary importance in these applications, there is no upper limit for tenacity for these fibers.

Fabrics in the structure of this invention can be made from a variety of high strength fiber-forming polymers, including, for example, extended chain polyolefins such as ultra-high molecular weight polyethylene, high strength poly(vinyl alcohol), poly(ethylene naphthalate), poly(p-phenylene benzobisoxazole), and the like, in addition to poly(p-phenylene terephthalamide).

It has been discovered that chainsaw protection is improved when adjacent layers of the protective structure are not joined in the areas of greatest need for protection. In other words, the protective structures should not be sewn together, for example, by criss-crossed stitching through the body of the material. It has been discovered that sewing the layers together has the effect of reducing the free length of yarns available for extraction by the chainsaw teeth and, therefore, of reducing the protection effectiveness of the structure. While the fabric layers can be sewn together or otherwise attached around the edges of the layers, it is important that, in the area of likely contact with the chainsaw teeth, the individual protective material layers act as independently as possible.

The preferred construction of layers in the protective structure of this invention includes alternating layers of the aforementioned woven fabric and a felt material, generally made from aramid staple fibers using a needling or hydrogen-tangling consolidation process. The felt is from 100 to 140 grams per square meter (3–4 ounces per square yard) and is 1 to 2.5 millimeters (0.04–0.1 inch) thick. Specifications for the felt are provided in Specification 6170-4D of the U.S. Department of Agriculture, Forest Service.

Figure 2:
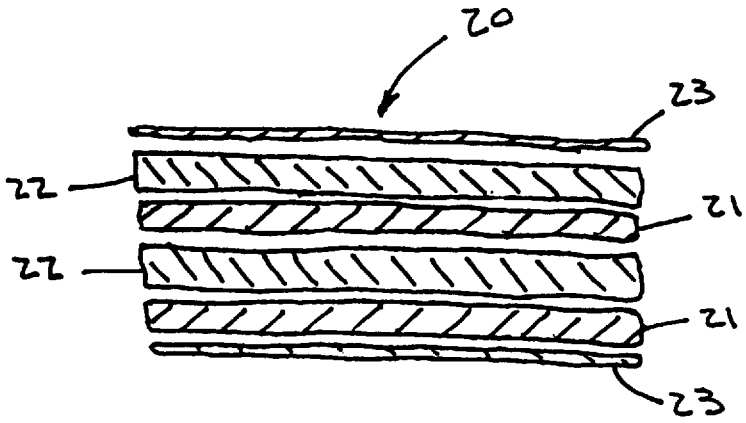
FIG. 2 represents a cross-sectional view of a sacrificial structure of this invention.

Referring to FIG. 2, protective structure 20 includes fabric layer 21 alternating with felt layer 22. Optionally, cover layer 23 may be provided for decoration, comfort, water proofing, or other desired auxiliary purpose. Cover layer 23 is a light weight inner or outer shell fabric which does not participate in providing chainsaw protection.

TEST METHODS

The fabric structures of this invention are evaluated in accordance with ASTM F 1414- 92a (Standard Test Method for Measurement of Cut Resistance to Chain Saw in Lower Body (Legs) Protective Clothing). Test results are reported as the Threshold Stopping Speed (TSS).

Except as may be otherwise specified herein, the fabric structures which are evaluated are the alternating fabric/felt material structure set out in Specification 6170-4D of the U.S. Department of Agriculture, Forest Service; and the felt is, also, as set out therein.

EXAMPLES

Example 1—Two fabrics were woven from continuous filament aramid yarn having a linear density of 1260 dtex. The yarn had a tenacity of 21.5 grams per dtex and a tensile modulus of 850 grams per dtex. The filaments in that yarn had a linear density of 1.65 dtex. The yarn was as sold by E. I. du Pont de Nemours and Company under the tradename of Kevlar® K-49.

One of the fabrics was a 17×17 Plain weave with a weight of 170 g/m$^2$ (5 oz/yd$^2$). This fabric served as the control or comparison for this example.

The other of the fabrics was a 17×17 ⅓ (4 Harness) Satin Weave (often called "Crowfoot Weave") with a weight of 170 g/m$^2$ (5 oz/yd$^2$).

A test structure was assembled using a felt conforming to the requirements of the aforementioned Specification 6170-4D—made from para-aramid fiber staple and having an areal density of about 200 grams/square meter (3.5 ounces/square yard) and a thickness of about 1.5 millimeters (0.06 inch).

The test structure included two layers of the woven fabric alternated with two layers of the felt and cover layers on the top and the bottom. The cover layers were medium weight nylon cloth; and the layers were bound together only around the periphery of the layers. In all cases, the first layer under the top cover layer was a woven aramid fabric. The Threshold Stopping Speed was determined in accordance with ASTM F 1414-92a.

The Threshold Stopping Speed for the two test structures was determined to be:

| Sample | (TSS) (m/s) |
|---|---|
| Invention | 13.6–15.0 |
| Comparison | 11.5–12.2 |

Example 2—Again, two fabrics were woven from continuous filament aramid yarn having a linear density of 1260 dtex. The filaments in this yarn had a linear density of 1.65 dtex, a tenacity of 21.5 grams per dtex, and a tensile modulus of 674 grams per dtex. The yarn was as sold by E. I. du Pont de Nemours and Company under the tradename of Kevlar® K-29.

One of the fabrics was a 17×17 Plain weave with a weight of 170 g/m$^2$ (5 oz/yd$^2$). This fabric served as the control or comparison for this example.

The other of the fabrics was a 17×17 ⅓ (4 Harness) Satin Weave (often called "Crowfoot Weave") with a weight of 170 g/m$^2$ (5 oz/yd$^2$).

The fabrics were used in a form with all of the usual filament and yarn finishes which normally accompany commercially-available fabrics (so-called "greige") and, also, in a form wherein those finishes were scoured from the fibers by usual commercial means using water and detergent. Tests were run using both forms.

Test structures were assembled using a felt conforming to the requirements of the aforementioned Specification 6170-4D—made from para-aramid fiber staple and having an areal density of about 200 grams/square meter (3.5 ounces/square yard) and a thickness of about 1.5 millimeters (0.06 inch).

The test structures included two layers of the woven fabric alternated with two layers of the felt and cover layers on the top and the bottom. The cover layers were medium weight nylon cloth; and the layers were bound together only around the periphery of the layers. In all cases, the first layer under the top cover layer was a woven aramid fabric. The Threshold Stopping Speed was determined in accordance with ASTM F 1414-92a.

The Threshold Stopping Speed for the test structures was determined to be:

| Sample | (TSS) (m/s) | Improvement (m/s) | Improvement (%) |
|---|---|---|---|
| Greige | | | |
| Invention | 15.5 | | |
| Comparison | 12.7 | 2.4 | 18.9 |
| Scoured | | | |
| Invention | 14.6 | | |
| Comparison | 12.3 | 2.3 | 18.7 |

What is claimed is:

1. A sacrificial fabric structure for protection from a moving chain saw blade including a plurality of superposed layers of fabric made from yarns having a tenacity of at least 10 grams per dtex and a tensile modulus of at least 150 grams per dtex woven in a 1/x satin weave wherein x is from 3 to 9.

2. The fabric structure of claim 1 wherein the yarns are aramid yarns.

3. The fabric structure of claim 1 wherein the yarn is made from filaments with a linear density of 1 to 8 dtex.

4. The fabric structure of claim 1 wherein the layers are bound together only around the periphery of the layers.

5. The fabric structure of claim 1 wherein the structure includes at least one layer of felt.

6. The fabric structure of claim 5 wherein the fabric and felt layers are alternated.

7. The fabric structure of claim 6 wherein the felt is made from aramid staple fibers.

8. The fabric structure of claim 1 wherein the aramid yarns include poly(p-phenylene terephthalamide) fibers.

9. The fabric structure of claim 1 wherein the fabric is made from aramid yarns woven in a ⅓ satin weave.

10. The fabric structure of claim 9 wherein the aramid yarns include poly(p-phenylene terephthalamide) fibers.

* * * * *